United States Patent [19]

Benteler et al.

[11] 4,319,471

[45] Mar. 16, 1982

[54] APPARATUS FOR PRODUCING A CORRUGATED TUBE

[75] Inventors: Hubertus Benteler, Bielefeld; Rainer Hansen; Egon Olszewski, both of Paderborn-Elsen; Ferdinand Wecker, Paderborn-Sennelager, all of Fed. Rep. of Germany

[73] Assignee: Benteler-Werke AG, Paderborn, Fed. Rep. of Germany

[21] Appl. No.: 162,041

[22] Filed: Jun. 20, 1980

[30] Foreign Application Priority Data

Feb. 9, 1980 [DE] Fed. Rep. of Germany ..... 3004838

[51] Int. Cl.[3] ..... B21D 15/06

[52] U.S. Cl. ..... 72/59; 72/62

[58] Field of Search ..... 72/57, 58, 59, 61, 62; 29/421 R

[56] References Cited

U.S. PATENT DOCUMENTS

| | | | |
|---|---|---|---|
| 2,217,799 | 10/1940 | Gesler | 72/59 |
| 2,796,109 | 6/1957 | Puster | 72/59 X |
| 3,099,311 | 7/1963 | Van Leer et al. | 72/59 |
| 3,339,386 | 9/1967 | Homfeldt | 72/59 |
| 3,512,385 | 5/1970 | Adolphi | 72/59 |
| 4,179,910 | 12/1979 | Mazier | 72/59 |

*Primary Examiner*—Leon Gilden

*Attorney, Agent, or Firm*—Michael J. Striker

[57] ABSTRACT

Apparatus for forming a corrugated tube from a smooth walled starting tube comprises a pair of receiving mandrels aligned spaced from each other along a preferably vertical axis and movable toward and away from each other to be engaged in opposite end portions of a starting tube. The halves of split corrugation forming discs and the halves of an end member above the uppermost of the discs, coupled together for limited movement in axial direction, are respectively carried and guided for movement in axial direction by a pair of clamping jaws tiltable between an open position permitting to align a starting tube with the mandrels and a closed position closing the split discs and the split end member and fluid tightly clamping opposite end portions of the starting tube located about said mandrels respectively between one of the mandrels and the closed end member and between the other mandrel and the clamping jaws. A channel for introducing pressure fluid into the interior of the starting tube leads through the other mandrel, while a ventilating channel in which a ventilating valve is arranged serves to discharge air from the starting tube during introduction of pressure fluid thereinto. A fluid operated cylinder and piston unit cooperates with the end member and the receiving mandrel engaged thereby for moving both elements in axial direction towards the other mandrel to thereby offset the starting tube and to deform the same into a corrugated tube.

14 Claims, 3 Drawing Figures

28
29
27
23
18
19
20
21
22
17
24
5
59
25
58
57
41
42
30
34
26
45
40
35
31
43
60
45
42
40'
40''
43
44
34
44
39
39
61
4
13
12
14
11
6
56
8
3
1
9
10
7
15
2
16

APPARATUS FOR PRODUCING A CORRUGATED TUBE

BACKGROUND OF THE INVENTION

The present invention relates to an apparatus for producing a corrugated tube from a smooth walled starting tube, which comprises clamping elements for fluidtightly engaging opposite ends of the starting tube, means for feeding a hydraulic pressure fluid into, respectively out of, the starting tube, split corrugation forming discs, and an hydraulically operated offsetting unit to axially compress the starting tube under simultaneous axial movement of the corrugation forming discs.

Such an apparatus is for instance known from the German Pat. No. 20 59 812. The deformation of the starting tube is thereby carried out in horizontal position of the latter. A carriage movable on the machine frame in upsetting direction is provided for this purpose, in which the carriage is provided with a head, tiltable about a vertical axis, with a horizontally extending hollow receiving mandrel for the starting tube and the corrugation forming discs mounted thereon.

To place the starting tube and the corrugation forming discs onto the mandrel, the latter has to be tilted from the offsetting direction to a position substantially normal thereto. In this position an intermediate member and subsequently thereto the smooth walled starting tube is moved by hand onto the receiving mandrel until the front end of the starting tube passes through a seal at the head and engages an abutment face of the latter. Subsequently thereto to split corrugation forming discs are individually, one after the other, placed against the outer circumference of the starting tube and connected with each other. Thereafter a comb-shaped distance holding member for maintaining the corrugation forming discs axially spaced from each other is placed against the latter and subsequently thereto an additional intermediate member is placed on the receiving mandrel. After all of these elements are placed on the receiving mandrel, the latter is tilted back to the offsetting position.

By actuating an offsetting unit, formed by a hydraulically operated cylinder and piston unit, the carriage is now moved in axial direction until the free end of the receiving mandrel engages into a pressure fluid housing and the corresponding end of the starting tube passes through a seal in a chamber formed in the pressure fluid housing. The starting tube is thereby clamped between an abutting face in this chamber and the aforementioned abutting face.

Pressure fluid is then fed over the pressure fluid housing into the receiving mandrel and over bores in the wall of the latter into the starting tube. The pressure of the hydraulic fluid is chosen in such a manner that the wall of the starting tube bulges outwardly between the corrugation forming discs so that the latter may not shift in axial direction.

At this moment the distance holding member may again be removed. By subsequent actuating the offsetting unit while maintaining fluid pressure in the interior of the starting tube, the starting tube will be axially offset so as to form corrugations between successive corrugation forming discs.

After the corrugation forming discs abut against each other, the formation of the corrugations in the starting tube is finished. The pressure fluid is subsequently thereto discharged from the finished corrugated tube and the offsetting unit is returned to its starting position. Subsequently thereto the carriage is returned to its starting position, the receiving mandrel is again tilted through 90° out of its offsetting position and only subsequent thereto it is possible to remove the corrugation forming discs, the intermediate members and the finished corrugated tube individually, one after the other, by hand from the receiving mandrel.

It is obvious that the production of corrugated tubes with this known apparatus is extremely cumbersome since not only a great number of manually carried-through operations are necessary but also, due to these manual operations, there will arise a great number of idle periods therebetween in which no corrugations are formed.

SUMMARY OF THE INVENTION

It is an object of the present invention to improve an apparatus of the aforementioned kind for the production of a corrugated tube in such a manner that manual operations are essentially avoided and the time for producing a corrugated tube is reduced, as compared with the time necessary for producing a corrugated tube with the known apparatus.

With these and other objects in view, which will become apparent as the description proceeds, the apparatus for producing a corrugated tube from a smooth walled starting tube mainly comprises support means, a pair of coaxially receiving mandrels axially spaced from each other and movable in axial direction toward each other, means mounted on the support means for moving said mandrels toward each other to tightly engage into opposite end portions of a starting tube placed axially aligned with said mandrels on the support means, a plurality of split corrugation forming discs superimposed and axially spaced from each other, a split end member arranged at one end of the superimposed discs, means connecting said discs and said end member for axial movement relative to each other, a pair of clamping jaws respectively carrying the split discs and the split end member, in which the clamping jaws are tiltable between an open position permitting placing a starting tube onto the mandrels and a closed position clamping one end portion of the starting tube between one of the mandrels and the closed end member and the other end portion of the starting tube between the other mandrel and the clamping jaws, means for feeding a pressure fluid into the interior of the starting tube and for discharging such pressure fluid from the finished corrugated tube, and offsetting means cooperating with said end member for moving the latter together with said one mandrel in axial direction towards the other mandrels to transform the starting tube into a corrugating tube.

Due to this construction it is possible to move the smooth walled starting tube to be provided with corrugation by means of a mechanically gripping system, which eventually may be controlled in a preprogrammed manner, from an initial position to a working position. In this working position the receiving mandrels are then inserted into opposite ends of the starting tube, whereby the starting tube is fixed in its position. The gripping system may now be released from the starting tube and tilted back.

Subsequently thereto, the clamping jaws with the corrugation forming discs and the corrugation forming disc end member will be tilted against the starting tube so that they enclose the latter over a predetermined working length. Due to the engagement of the opposite ends of the starting tube by the receiving mandrels and due to the pressing of the tube ends against the receiving mandrels by means of the clamping jaws, a definite pressure space is created in the interior of the starting tube.

By impinging the interior of the starting tube with pressure fluid, the wall of the starting tube bulges at first slightly outwardly between the corrugation forming discs. Subsequently thereto, the offsetting apparatus is supplied with pressure fluid, which acts at first against the corrugation forming disc end member to axially displace tube in axial direction. Due to the relative movable connection of the end member with the adjacent corrugation forming disc and the following corrugation forming discs, the end member is at first pressed against the corrugation forming disc adjacent thereto to thus form the first corrugation, and subsequently thereto this first corrugation forming disc is pressed against the following, and so on, until all of the corrugation discs abut against each other so that the corrugating of the starting tube will be finished.

Subsequently thereto, the offsetting aggregate is returned to its starting position and simultaneously the pressure fluid is discharged from the finished corrugated tube. The clamping jaws with the corrugation forming discs and the corrugation forming disc end member mounted therein are then tilted away from the finished corrugated tube so that the latter remains only clamped between the receiving mandrels. The gripping system can now be again moved to grip the finished corrugated tube. The receiving mandrels are subsequently thereto moved back to their starting position and the finished corrugated tube may be moved by the gripping system away from the apparatus of the present invention to a magazine or to an apparatus performing further operations on the corrugated tube.

A special advantage of the apparatus of the present invention is, on the one hand, the elimination of manual operations in preparing the offsetting and corrugation forming steps and, on the other hand, the elimination of manual operations after the corrugated tube has been finished. The clamping of the starting tube, as well as the release of the finished corrugated tube is mechanically performed and can be programmed in proper sequence. Thereby the possibility exists to produce also conically-shaped corrugated tubes by a corresponding change of the corrugation forming discs and the clamping jaws or to produce corrugated tubes with different distances between successive corrugations and also with different wall thickness, whereby, of course, a corresponding starting tube is necessary.

An easy exchange of the corrugation forming discs and of the forming discs end member is assured with the present invention in that the corrugation forming discs and the corrugation forming disc end member are mounted in dish-shaped cutouts of the clamping jaws and guided therein. Such mounting and guiding assure also a perfect transmission of radially acting forces arising during the formation of the corrugations, without requiring overdimensioning of the clamping jaws and the aggregates moving the latter.

An especially advantageous construction according to the present invention consists in that the corrugation forming discs and the corrugation forming end member are moved in offsetting direction of the starting tube by means of an offsetting aggregate arranged axially aligned with the starting tube and that the corrugation forming discs and the corrugation forming disc end member may be moved in a direction opposite to the offsetting direction away from each other by means of return aggregates incorporated in the clamping jaw and coupled to the forming disc end member. The offsetting aggregate as well as the return guiding aggregates are thereby preferably constructed as hydraulically operated cylinder and piston means.

When the clamping jaws are inwardly tilted, a force is exerted onto the starting tube by the axially acting offsetting aggregate, which, in connection with the pressure created by the pressure fluid in the interior of the starting tube and, the pressure of the corrugation forming discs onto the outer surface of the starting tube will assure an exact forming of the corrugations. In addition, by the arrangement of the return guiding aggregates in the clamping jaws it is also possible to move the forming disc end member in opposition to the offsetting direction, and thereby due to the connection of the forming disc end member with the adjacent corrugation forming disc, on the one hand, as well as by the connection of the other adjacent corrugation forming discs to each other, on the other hand, it is possible to return the corrugation forming discs, after forming of the corrugation has been finished, without any manual operation and without any loss of time to their starting position. By proper parallel operation of the two return guide aggregates in the clamping jaws, jamming of the corrugation disc end member and the corrugation discs during the return movement is positively avoided.

The perfect axial position of the corrugation forming disc end member and the corrugation forming discs during the offsetting operation as well as during the return movement is, according to the present invention, assured in that the end member and the corrugation forming discs are coupled by axial bolts with each other. These axial bolts are connected to the end member, respectively the corrugation forming discs, and pass axially shiftable with cylindrically guide portions through in offsetting direction adjacent corrugation forming discs.

Preferably, the axial bolts between two adjacent corrugation forming discs, respectively between the end member and the adjacent corrugation discs are offset in circumferential direction with respect to each other.

Preferably, the axial bolts have at one end a threaded portion screwed into a threaded bore of the corresponding corrugation forming end member, respectively the corrugation forming discs and at the other end a head. An advantageous construction of the clamping jaws in which the corrugation forming discs and the end member are mounted and guided consists, according to the present invention, in that the clamping jaws are tiltable about a common tilting axis located laterally of and parallel to that of the mandrels and are tilted about this tilting axis by a pair of knuckle joints and fluid-operated cylinder and piston means connected thereto. These knuckle joints will not only assure a proper clamping position for the starting tube during the corrugation forming process, but in addition thereto they will also assure that the aforementioned fluid-operated cylinder and piston means connected thereto need only bring the clamping jaws to the proper clamping position. During the actual forming of the corrugation, the clamping position is assured by the toggle joints and not by a force provided by the cylinder and piston means connected thereto.

The means for moving the mandrels towards each other comprise a pair of fluid-operated cylinder and piston means respectively connected to the mandrels. Each of the mandrels is preferably substantially hat-shaped and has a frusto-conical portion at one end thereof facing the other mandrel, a cylindrical sealing portion following said frusto-conical portion and a radially outwardly extending flange portion at the other end to be tightly engaged by the end member respectively the clamping jaws upon movement of the latter to the closed position.

The conical end of each mandrel serves to facilitate its entrance into the respective end of the starting tube, without damaging the latter. The cylindrical sealing portion of each mandrel is made long enough in order to properly support the respective starting tube end portion and to assure in connection with the clamping jaws and the corrugation forming disc end member a proper seal necessary for the forming of the corrugations. In order to assure that the flanges of the mandrels will be properly gripped by the clamping jaws, respectively the corrugation forming disc end member, there are provided in the clamping jaws respectively in the two halves of the end member, grooves for receiving the flanges of the mandrels. In this way a relative movement of the mandrels relative to the end member, respectively the clamping jaws, is prevented when the clamping jaws are brought to their closed position. These flanges provide also abutment faces for the opposite ends of the starting tube.

The offsetting means are preferably fluid-operated cylinder and piston means, coaxial with the fluid-operated cylinder and piston means which cooperate with the mandrel which is introduced in offsetting direction into the interior of the starting tube. The integration of the two fluid-operated cylinder and piston means reduce the necessary space for their mounting and will also assure that the one mandrel is properly taken along with the offsetting means during operation of the fluid-operated cylinder and piston means of the latter.

The introduction of the pressure fluid into the starting tube and the discharge of the pressure fluid which, for instance, comprises an oil-water emulsion, from a finished corrugated tube can be accomplished in different ways. Preferably, this introduction is accomplished, according to the present invention, through an elongated channel passing in axial direction through the mandrel which is gripped by the clamping jaws and through the fluid-operated cylinder and piston means cooperating therewith. This channel opens at its inner end into the interior of the starting tube, whereas the outer end is connected to a supply of pressure fluid.

A further advantageous feature of the present invention is characterized in that the mandrel which is gripped by the corrugation forming disc end member and the fluid-operated cylinder and piston means cooperating with this mandrel are provided with a venting passage extending in axial direction therethrough. Preferably a venting valve is incorporated in this passage. When hydraulic pressure fluid is introduced into the starting tube, then the air in the starting tube can escape through the venting valve adjusted for the different viscosity of air and liquid. For this purpose a valve member or closing piston is provided in the venting valve past which gas may freely flow. However, liquids will take the closure piston along in closure direction to press the piston against the corresponding sealing face to thus close the venting valve.

The starting tube may be arranged horizontally or vertically. Preferred, however, is a construction in which the starting tube is clamped in vertical position. This will not only reduce the necessary space for the apparatus, but will also facilitate placing the starting tube in the apparatus and removing the finished formed corrugated tube therefrom.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
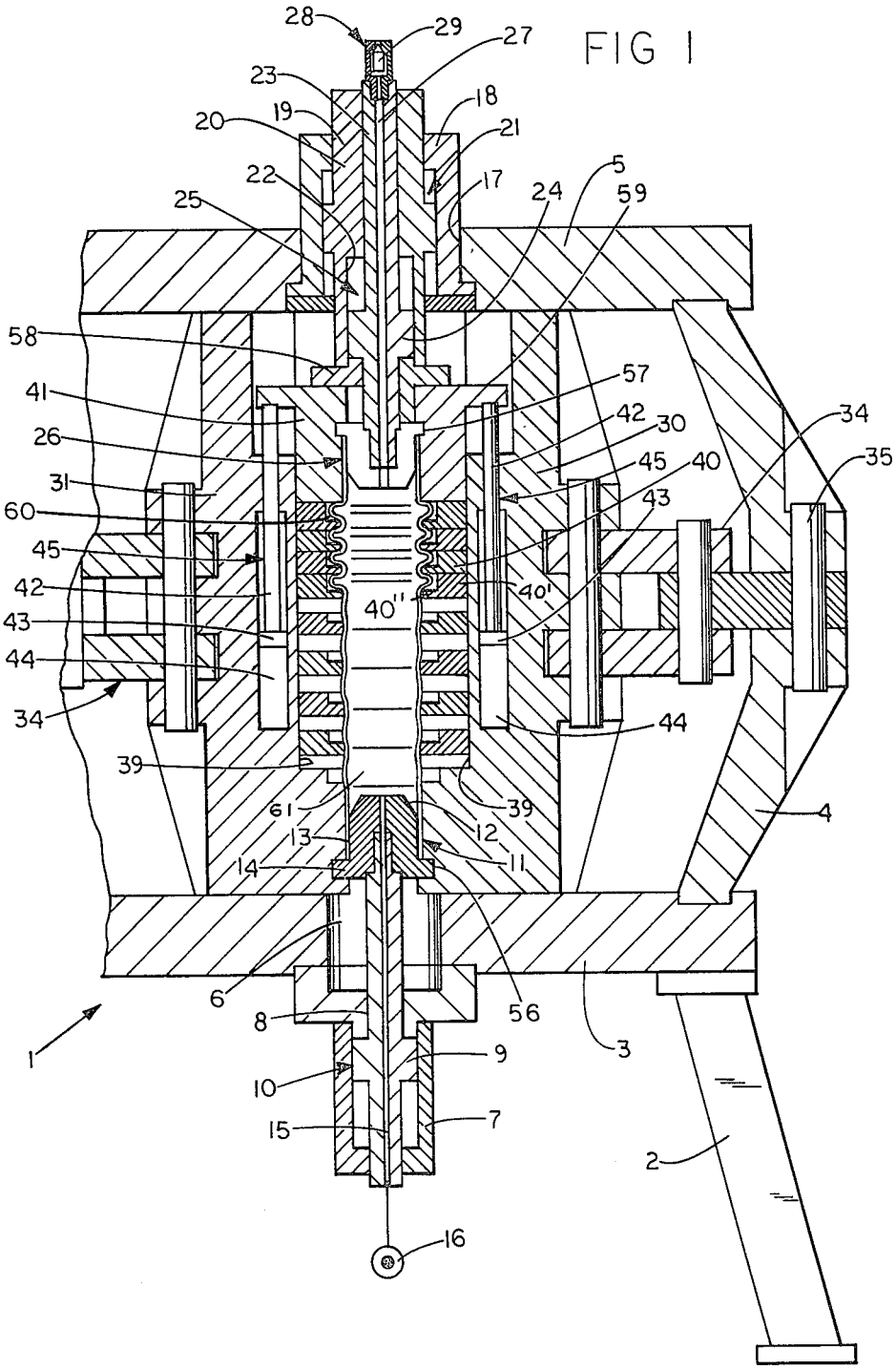
FIG. 1 is a somewhat schematic, partial vertical cross section through the apparatus of the present invention.

The apparatus of the present invention for producing a corrugated tube from a smooth walled starting tube is designated in FIG. 1 with reference numeral 1. The apparatus 1 is provided with a horizontally extending bottom plate 3 supported on legs 2, of which only one is shown in FIG. 1, and a horizontally extending cover plate 5 supported upwardly spaced from the bottom plate 3 by a plurality of struts 4.

A stepped central cutout 6 is provided in the bottom plate 3, into the section of larger diameter of which a housing 7 is inserted from below. A cylinder and piston unit 10 having a piston 9 and a piston rod 8 connected thereto are mounted in the housing 7 movable in vertical direction. The cylinder and piston unit 10 is fluid operated, but, for simplification reason, the necessary connections for introducing hydraulic pressure fluid into the cylinder and piston unit 10 are omitted from the drawing.

The piston rod 8 carries at its upper end a hat-shaped receiving mandrel 11 having a conical end portion 12, a cylindrical bearing, respectively sealing section 13 and, opposite the conical portion 12, a flange 14. The mandrel 11 and the corresponding end of the piston rod 8 extending thereinto may be connected to each other by a proper press fit. A longitudinal channel 15 passes in axial direction through the piston rod 8 and the mandrel 11. The outer end of the channel 15 is connected to a source of hydraulic pressure fluid 16.

The cover plate 5 is likewise provided with a stepped cutout 17, coaxial with the cutout 6 in the bottom plate, and a housing 18 is placed into the cutout 17 in the cover plate 5 and connected to the latter. A piston 20 with a hollow piston rod 19 is reciprocatively mounted in the housing 18 and forming with the latter a hydraulically operated cylinder and piston unit 21. The necessary connections for introducing hydraulic pressure fluid into this unit are again not illustrated in the drawing.

The hollow piston rod 19 is provided with a stepped bore 22 extending in axial direction therethrough, in which the piston rod 23 and the piston 24 of a further hydraulically operated cylinder and piston means 25 is vertically reciprocatable. The necessary fluid connections for the cylinder and piston unit 25 are likewise omitted from the drawing. A receiving mandrel 26 is releasably connected to the lower end of the piston rod 23 and the mandrel 26 is constructed in the same manner as the above described mandrel 11. A venting channel 27 passes in axial direction through the mandrel 26 and the piston rod 23. A venting valve 28 a closure piston 29 is connected to the upper end of the venting channel 27.

Figure 2:
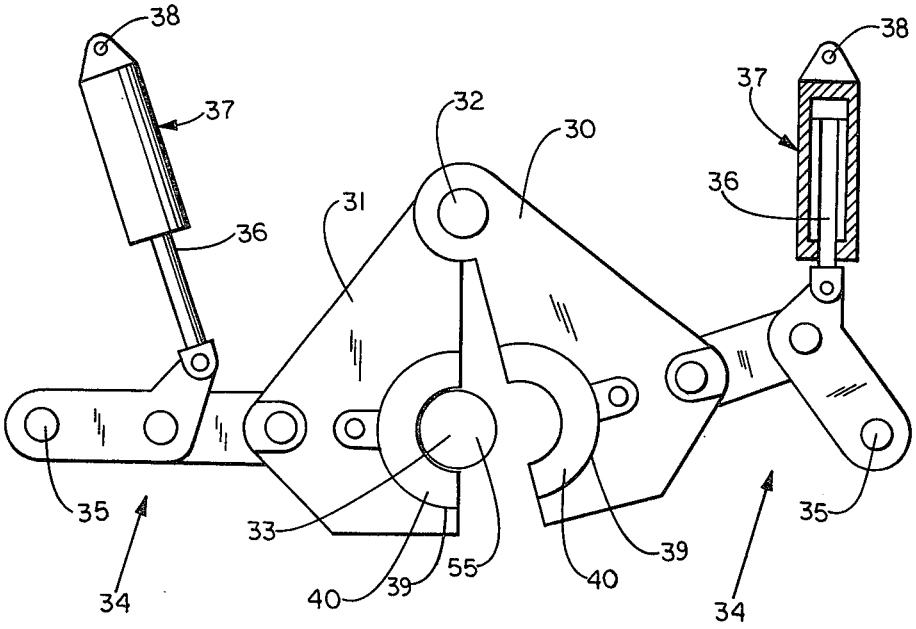
FIG. 2 is a top view of the clamping jaws and the means for moving the same between an open and a closed position.

As shown in FIGS. 1 and 2, two clamping jaws 30 and 31 are slidably guided between the bottom plate 3 and the cover plate 5 and these clamping jaws are tiltable about a common vertical tilting axis 32, which is parallel and laterally arranged with respect to the common axis 33 of the mandrels 11 and 26. The clamping jaws 30 and 31 are respectively movable by toggle joints 34 which are connected at the outer ends to vertical pins mounted in the struts 4 and which are respectively connected to piston rod 36 of hydraulically operated cylinder and piston unit 37. FIG. 2 illustrates to the left side of the tilting axis 32 the clamping jaw 31, the toggle joint 34 and the cylinder and piston unit 37 in closed position, whereas at the right side these elements are shown in the open position. The cylinder and piston unit 37 are tiltably connected at their outer ends at 38 on the apparatus 1.

The clamping jaws 30 and 31 are provided with half cylindrically bearing boxes 39 parallel to the common axis 33 of the mandrels 11 and 26. A plurality of corrugation forming discs 40 are mounted and axially guided in the bearing boxes 39. Each bearing box receives thereby one-half of the corrugation forming discs 40, which, at closed clamping jaws 30 and 31, are likewise joined to closed forming discs. A corrugation forming end member 41 is also mounted at the upper end of the superimposed corrugation forming discs 40, and axially guided in the bearing boxes 39. The corrugation forming disc end member 41 is likewise composed of two halves, whereby each half is guided by a piston rod 42 and a piston 43 at the end thereof reciprocatable in a cylinder 44 respectively provided in the clamping jaws 30 and 31. The cylinder and piston unit 45 formed by the cylinder 44 and the piston 43 is likewise hydraulically operated, whereby the necessary connections for introducing the hydraulic fluid into the cylinders 44 are not illustrated in the drawing.

Figure 3:
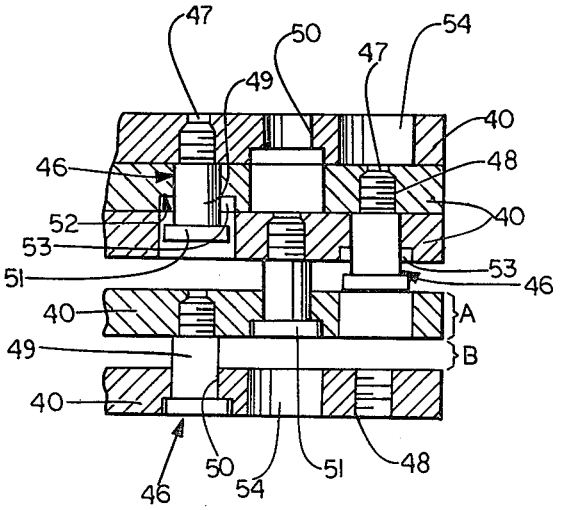
FIG. 3 is an enlarged vertical cross section through parts of adjacent corrugation forming discs and the means connecting the same to each other for limited axial movement.

The corrugation forming disc end member 41 and the corrugation forming disc 40 adjacent thereto, as well as the following adjacent corrugation forming discs 40, are connected to each other by a plurality of circumferentially displaced axial bolts 46. As best shown in FIG. 3, each of the axial bolts has an upper threaded end portion 47 screwed into a corresponding threaded bore 48 of the respective next higher corrugation forming discs 40, respectively the end member 41. A cylindrically guided portion 49 follows the threaded end portion 47 of each bolt and passes through a bore in the respective corrugation forming disc 40 with a slide fit to permit axial movement of the corrugation discs with respect to each other, while preventing any radial movement. Each bolt 46 is provided at the lower end thereof with a head 51 of a larger diameter than the bore 50 to limit axial movement of adjacent corrugation forming discs 40 with respect to each other. As can be visualized from FIG. 3 the distance between the corrugations is determined by the thickness A of the corrugation forming discs 40 and the offsetting dimension is determined by the distance B between two adjacent corrugation forming discs 40, which in turn results from the play between the head 51 of the axial bolts 46 and the corresponding abutment face 52 at the cutouts 53 of the corrugation forming discs. As further clearly shown in FIG. 1, each of the corrugation forming discs 40 has an outer portion 40' of greater height than an inner portion 40'' and the latter has a convexly curved end face.

In order that the axial bolts 46 may perform their function there are provided bores 54 in each corrugation forming disc 41 for the passage of the heads 51 of the respective bolts 46 therethrough.

The above described apparatus will operate as follows:

At the start of the operation the clamping jaws 30 and 31 are open and the receiving mandrels 11 and 26 are respectively downwardly and upwardly retracted. It is now possible to place, by means of a non-illustrated gripping system, a smooth walled starting tube 55 (see FIG. 2) in position in the apparatus in which the longitudinal axis of the starting tube 55 is aligned with the common axis 33 of the mandrels 11 and 26. Subsequently thereto, the mandrels 11 and 26 are moved toward each other into the opposite ends of the starting tube 55 by means of the fluid-operated cylinder and piston means 10 and 25, until the opposite end faces of the starting tube 55 abut against the flanges 14 of the mandrels 11 and 26. The position of the starting tube 55 in the apparatus is thus properly fixed, so that the gripping system may be released from the starting tube and moved out of the working region of the apparatus.

Pressure fluid is then fed into the cylinder and piston means 37, so that the clamping jaws 30 and 31 together with the corrugation forming discs 40 and the forming disc end member 41 are tilted about the tilting axis 32 and pressed against the outer periphery of the starting tube 55 and in this position held by the toggle joints 34. The corrugation forming discs 40 are thereby held in predetermined axial distances from each other. Due to the direct engagement of the clamping jaws 30 and 31 with the outer surfaces at the lower end of the starting tube 55, the latter will be clamped and fluid tightly sealed against the sealing section 13 of the mandrel 11. Since also the corrugation forming disc end member 41 is pressed by the clamping jaws 30 and 31 onto the outer surface at the upper end of the starting tube 55, also the upper end of the starting tube is exactly and fluid tightly pressed against the sealing section 13 of the mandrel 26. The flanges 14 of the mandrels 11 and 26 engage thereby in the corresponding grooves 56 in the clamping jaws 30 and 31, respectively in the grooves 57 in the halves of the corrugation forming disc end member 41.

Hydraulic pressure at predetermined pressure is now introduced from the source of pressure fluid 16 into the interior of the starting tube 55, whereby the air in the starting tube 55 can escape through the venting channel 27 and the venting valve 28 into the atmosphere. After all of the air has escaped, the venting valve 28 will close, so that the pressure of the pressure fluid in the interior of the starting tube 55 may be increased until the wall of the starting tube 55 bulges slightly outwardly between the axially displaced corrugation forming discs 40.

While the fluid pressure in the exterior of the starting tube 55 is maintained, pressure fluid is introduced into the offsetting cylinder and piston means 21, so that the pressure ring 58 of the unit 21 abuts against the upper surface 59 of the corrugation forming disc end member 41 to press the latter against the adjacent corrugation forming disc 40. Thereby the first corrugation 60 is formed between the end member 41 and the adjacent corrugation forming disc 40. The second corrugation is formed when the corrugation forming disc 40 bordering the end member 41 is pressed against the, in offsetting direction adjacent, corrugation forming disc 40, and one corrugation after the other is thus formed during further downward movement of the end member 41 as all corrugation forming discs are moved in engagement with each other.

After the starting tube 55 is thus formed into a corrugated tube 61 the pressure fluid is discharged from the latter. Subsequently thereto, the clamping jaws 30 and 31 are opened by means of the cylinder and piston means 37, whereby also the split corrugation forming discs 40 and the split end member 41 are moved to the open position. Subsequently thereto, the finished corrugation tube 61 may be gripped by the non-illustrated gripping system. The offsetting cylinder and piston means 21 is then moved upwardly to its starting position and the mandrels 11 and 26 are retracted. The finished corrugated tube may now be transported by the gripping system out of the apparatus to a magazine or to a further apparatus performing additional operations on the corrugated tube. In order to render the apparatus 1 ready for the next corrugation forming operation it is still necessary to actuate the return aggregates 45 in the clamping jaws 30 and 31 in a direction that the halves of the forming disc end member 41 are moved vertically upwardly, whereby the axial bolts 46, shown in FIG. 3, take the corrugations forming discs, one after the other, along until the latter reach the starting position in which the discs are spaced in axial direction from each other.

It will be understood that each of the elements described above, or two or more together, may also find a useful application in other types of apparatus for producing corrugated tubes differing from the types described above.

While the invention has been illustrated and described as embodied in an apparatus for producing a corrugated tube from a smooth walled starting tube it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for producing a corrugated tube from a smooth walled starting tube, comprising support means; a pair of coaxial receiving mandrels axially spaced from each other and movable in axial direction toward each other; means mounted on said support means for moving said mandrels toward each other to tightly engage into opposite end portions of a starting tube placed axially aligned with said mandrels on said support means; a plurality of split corrugation forming discs superimposed and axially spaced from each other; a split end member arranged at one end of said superimposed discs; means connecting said discs and said end member for axial movement relative to each other; a pair of clamping jaws respectively carrying said split discs and said split end member, said clamping jaws being tiltable between an open position permitting to align a starting tube with said mandrels and a closed position fluid tightly clamping one end portion of the starting tube between one of said mandrels and the closed end member and the other end portion of the starting tube between the other mandrel and said clamping jaws; means for feeding a pressure fluid into the interior of the starting tube and for discharging such pressure fluid from the finished corrugated tube; and offsetting means cooperating with said end member for moving the latter together with said one mandrel in axial direction toward the other mandrel to transform the starting tube into a corrugated tube.

2. Apparatus as defined in claim 1, wherein said corrugation forming discs and said end member are mounted and guided in concavely formed cutouts of the clamping jaws extending parallel to the axis of said mandrels.

3. Apparatus as defined in claim 1, wherein said offsetting means projects coaxial with said one mandrel beyond the latter and including return means incorporated in the clamping jaws and cooperating with said end member for moving the latter in a direction opposite to the offsetting direction.

4. Apparatus as defined in claim 1, and including coupling means for coupling said end member and said corrugation forming discs for limited movement in axial direction away from each other.

5. Apparatus as defined in claim 4, wherein said coupling means comprise a plurality of bolts having axes parallel to that of said mandrels, and being fixedly connected at one end to said end member, respectively to said corrugation forming discs, said bolts passing with cylindrical guide portions through corresponding bores of in offsetting direction adjacent corrugation forming discs and having each at the other end thereof a head.

6. Apparatus as defined in claim 1, wherein said clamping jaws are tiltable about a common tilting axis located laterally and parallel to that of said mandrels and including a pair of toggle joints and fluid operated cylinder and piston means connected thereto for tilting said clamping jaws about said tilting axis.

7. Apparatus as defined in claim 1, wherein said means for moving said mandrels toward each other comprise a pair of fluid operated cylinder and piston means respectively connected to said mandrels.

8. Apparatus as defined in claim 1, wherein each of said receiving mandrels is substantially hat-shaped and having a frusto-conical portion at an end thereof facing the other mandrel, a cylindrical sealing portion following said frusto-conical portion and a radially outwardly extending flange portion at the other end to be tightly engaged by said end member, respectively by said clamping jaws upon movement of the latter to said closed position.

9. Apparatus as defined in claim 7, wherein said offsetting means comprises fluid operated cylinder and piston means coaxial with said fluid operated cylinder and piston means cooperating with said one mandrel.

10. Apparatus as defined in claim 7, wherein said means for introducing pressure fluid into the starting tube and for discharging said pressure fluid from the finished corrugated tube comprises a passage extending through the other receiving mandrel and the cylinder and piston means cooperating therewith.

11. Apparatus as defined in claim 7, and including a ventilating channel extending through said one receiving mandrel and the cylinder and piston means coordinated therewith.

12. Apparatus as defined in claim 11, and including a ventilating valve in said ventilating channel.

13. Apparatus as defined in claim 1, wherein said receiving mandrels are aligned along a vertical axis.

14. Apparatus as defined in claim 1, wherein each of said corrugation forming discs comprises a radial outer portion of greater thickness than a radial inner portion thereof and wherein said inner portion has a free end of substantially semi-circular cross-section adapted to engage the starting tube.

* * * * *